US007270343B2

(12) United States Patent
Riepler

(10) Patent No.: US 7,270,343 B2
(45) Date of Patent: Sep. 18, 2007

(54) FLEXIBLE CONNECTION BETWEEN SPORTS DEVICE AND SHOE

(75) Inventor: Bernhard Riepler, Wagrain (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 200 days.

(21) Appl. No.: 10/970,944

(22) Filed: Oct. 22, 2004

(65) Prior Publication Data

US 2005/0051996 A1 Mar. 10, 2005

Related U.S. Application Data

(62) Division of application No. 09/831,658, filed as application No. PCT/AT99/00260 on Nov. 3, 1999, now Pat. No. 6,843,497.

(30) Foreign Application Priority Data

Nov. 12, 1998 (AT) ..... 1890/98

(51) Int. Cl.
*A63C 9/00* (2006.01)

(52) U.S. Cl. ..... 280/615; 280/11.224

(58) Field of Classification Search ..... 280/614, 280/615, 11.27, 11.28, 11.3, 11.31, 11.32, 280/11.33, 631, 634, 611, 613, 616, 623, 280/11.224; 36/115
See application file for complete search history.

(56) References Cited

U.S. PATENT DOCUMENTS

| | | | | | |
|---|---|---|---|---|---|
| 4,789,177 | A | * | 12/1988 | Graillat | 280/607 |
| 4,907,817 | A | * | 3/1990 | Schwarz | 280/615 |
| 4,945,658 | A | * | 8/1990 | Provence | 36/117.2 |
| 5,190,309 | A | * | 3/1993 | Spitaler et al. | 280/615 |
| 5,405,156 | A | * | 4/1995 | Gonella | 280/11.28 |
| 5,462,295 | A | * | 10/1995 | Seltzer | 280/11.19 |
| 5,947,507 | A | * | 9/1999 | Quintana et al. | 280/615 |
| 6,003,893 | A | * | 12/1999 | Hansen | 280/624 |
| 6,017,050 | A | * | 1/2000 | Girard | 280/615 |
| 6,082,744 | A | * | 7/2000 | Allinger et al. | 280/11.12 |
| 6,152,458 | A | * | 11/2000 | Edauw et al. | 280/11.14 |
| 6,308,979 | B1 | * | 10/2001 | Ludlow | 280/615 |
| 6,402,184 | B1 | * | 6/2002 | Hauglin | 280/615 |
| 6,499,761 | B1 | * | 12/2002 | Quellais | 280/623 |
| 6,736,412 | B1 | * | 5/2004 | Krah | 280/11.224 |
| 6,843,497 | B1 | * | 1/2005 | Riepler | 280/615 |

FOREIGN PATENT DOCUMENTS

| | | | |
|---|---|---|---|
| CH | 659 397 | | 1/1987 |
| DE | 3406439 | * | 8/1985 |
| DE | 196 35 250 | | 3/1997 |
| DE | 198 46 007 | | 4/1999 |
| EP | 194633 | * | 9/1986 |
| EP | 0 914 844 | | 5/1999 |
| FR | 2 573 317 | | 5/1986 |
| FR | 2 659 534 | | 9/1991 |
| WO | 87/01296 | | 3/1987 |
| WO | 96/37269 | | 11/1996 |
| WO | 99/21625 | | 5/1999 |

* cited by examiner

*Primary Examiner*—Christopher P. Ellis
*Assistant Examiner*—Brian Swenson
(74) *Attorney, Agent, or Firm*—Collard & Roe, P.C.

(57) ABSTRACT

The invention describes a pivotable binding system (1) for mounting between a sports device (2) and a tread surface (5) for a user's foot, in which the tread surface (5) is pivotable about an axis extending more or less parallel with the ankle joint of the foot and is displaceable, at least in a part region assigned to the toes, to a position closer to the sports device (2), and can be joined to the sports device by at least one binding element (11). The binding element (11) is flexible and is resiliently deformable in a vertical plane (8).

16 Claims, 5 Drawing Sheets

FLEXIBLE CONNECTION BETWEEN SPORTS DEVICE AND SHOE

This is a divisional of application Ser. No. 09/831,658 filed on May 11, 2001 now U.S. Pat. No. 6,843,497; International Application PCT/AT99/00260 filed on Nov. 3, 1999 and which designated the U.S.

The invention relates to a pivotable binding system between a sports device and a tread surface for a user's foot as well as a shoe and sports device for the binding system as outlined in the claims.

WO 96/37269 A1 discloses a device for binding a shoe to a sports device. This device comprises a top part frame, which can be connected to a user's shoe, and pivotably connected to a bottom part frame by means of a hinge mechanism comprising a plurality of linking arms and joints designed to be fixed to various sports devices. The linking mechanism connecting the top to the bottom part frame is constructed so that a pivoting movement of the top part frame relative to the bottom part frame simultaneously causes the two part frames to slide relative to one another. Return spring means are additionally provided which elastically push the two part frames against one another into a predefined relative position. The disadvantage of this system is that correct operation can be easily impaired under difficult conditions of use.

WO 87/01296 A1 describes a binding system between a shoe and a sports device, in particular a binding for a touring ski, in which the articulated link to the sports device is disposed/the region assigned to the ball of the foot. As a result, the binding system for the user's shoe can be displaced into an upper, active position, which permits a pivoting action relative to the sports device about the articulated binding, and a lower, locked position in which the binding is prevented from pivoting. The disadvantage of this system is that it is difficult to switch the articulated binding from the active into the locked position and vice versa and the shear forces or twisting forces which occur between the sports device and the user's foot relative to a vertical axis place high demands on the parts used. Furthermore, when the binding system is in the active position, the central region of the sports device underneath the user's shoe is placed under a high degree of strain due to the fact that the bearing points are small in surface area or linear in shape. Another disadvantage is the fact that the front region of the sports device may rise if the user leans backwards.

FR 2 573 317 A1 discloses a binding system between a shoe and a sports device, which enables both a pivoting movement of the shoe relative to the sports device about a pivot axis running transversely to its longitudinal axis and, simultaneously, a relative displacement of the shoe in the longitudinal direction of the sports device. The disadvantage of this is that the user of this binding system is unable to get a firm hold on the sports device, which reduces performance. Another disadvantage is that the kickoff which can be achieved with this system is difficult to control and a certain amount of instability in the kickoff is unavoidable, particularly if there is a change in ground conditions.

CH 659 397 A5 discloses a ski binding for crosscountry skiing. A first plate is provided, to which a ski shoe can be fixed. This first plate is joined to a second plate by means of a stable lever having two joints provided at its end regions. The second plate is of a design similar to a shoe sole so that it can be received by a conventional ski binding in a manner akin to a ski shoe. When this device is in the initial or rest position, in which the first plate and the second plate extend substantially parallel with one another, the first plate is supported so as to transfer load to the second plate. In addition, a flexible, resilient, stretchable tension strap is provided between the first plate and the second plate, which is stretched when the first plate is pivoted relative to the second plate and the movement of the first plate relative to the second plate is opposed by an elastic resistance and subsequently assists the return movement to the initial or rest position. This configuration produces a two-stage motion, whereby the connecting level is pivoted jointly with the first plate into an end position during the first phase of movement and the joint facing the first plate does not become active until the end of this first phase of movement. These sequential pivoting movements about the two pivot axes of joints spaced apart from one another cause a disadvantageous, perceptible transfer of movement or a sudden jerk in the displacement after a certain pivot angle. This jerky movement occurs with the transition from the first pivoting phase to the second pivoting phase, namely when the displacement about the first joint has terminated and the second joint, having a different centre of gravity, comes into play. A similar jerky movement occurs during the return to the initial or rest position.

FR 2 659 534 A1 discloses what is referred to as a collapsible skating shoe arrangement, in which a sport shoe is releasably joined as required to an articulated binding device with a skating shoe blade. This binding system comprises a jaw configuration displaceable by means of an operating lever, which can be coupled by a positive fit with a shaft bolt on the shoe side. This shaft bolt is secured in the front toe cap region of the shoe. In addition, this binding system additionally has a resilient, flexible counter-bearing, which is supported on the region of the tip of the foot and duly applies a mechanical resistance against an upward pivoting motion of the shoe. The disadvantage of this configuration is that the sport shoe is primarily pivoted about a rigid axis in the foremost toe region. The naturalness of the movement is impaired as a result.

The objective of the present invention is to provide a pivotable binding system between a user's foot and a sports device, which can enhance the performance of a user.

This objective is achieved by the invention due to the features outlined in claim 1. The particular advantage of this design is that relatively few and simple components imitate the natural rolling action of the foot across the bottom of the toes so that the performance of every user can be enhanced. Surprisingly, however, the enhanced performance which can be achieved by using the design proposed by the invention is not accompanied by any impairment to comfort. On the contrary, comfort is perceptibly increased due to the harmonious or rounded movement of the binding system. The combined or largely rigidly coupled motion of the user's foot in translation and rotation relative to the sports device during the active phase of the binding system, i.e. when assuming a specific pivot position, gives the user a feeling of stability and functional safety. As a result, he can concentrate on the respective performance and does not have to consciously concentrate his efforts on a perfect rolling motion since this is pre-programmed by the binding system to a certain degree. Furthermore, the binding system consists of few individual components, which makes the design optimum in terms of weight whilst nevertheless enabling the advantageous rolling motion in translation and rotation. At the same time, any undesirable movement between the user's foot and the sports device, such as twisting about a vertical axis, can be reliably prevented, thereby producing a high resistance to force. Because of the small number bearing points, friction losses between the linking parts of the binding system can be kept particularly low, so that the use's potential to perform can be largely converted into kinetic energy to propel the sports device along. Another important advantage resides in the fact that the sole of the sport shoe, for example a cross country shoe, can be made to a more bend-resistant design than similar conventional sport shoes because the harmonious or flowing movement needed for an optimum forward propulsion can be produced by the binding device. The natural forward rolling motion across the heels when walking or running is simulated by the binding system proposed by the invention, thereby enhancing comfort when using the sports device. Because the sport shoe can be made relatively more resistant to bending, the driving energy, thereby simultaneously enhancing performance without, as one might expect, impairing comfort.

An embodiment is of advantage since the flexible binding element enables an unhindered pivoting action of the sport shoe relative to the sports device whilst nevertheless retaining the sport shoe in a longitudinal direction relative to the sports device.

Advantage is to be had from another embodiment, whereby a long pivoting motion can be produced and no mechanical resistance has to be overcome in order to produce this pivoting motion.

The embodiment is such that the sports device is not normally lifted by the underside of the shoe sole and the shoe sole is therefore always in contact with the sports device, affording a positive operating behaviour or positive feeling of motion.

As a result of the advantageous embodiment, when the sports device impacts with the ground underneath to produce a forward movement, the kicking force applied by the user is converted into driving energy with virtually no loss.

The embodiment in a lateral guide device makes the sport shoe easy to walk in without problems when removed from the binding system.

A robust and totally safe binding is achieved between the sport shoe and the sports device as a result of the advantageous embodiment.

As a result of the embodiment, the sport shoe is firmly retained in the longitudinal direction of the sports device whilst affording the desirable play, namely the pivoting motion relative to the sports device about a horizontal axis.

The embodiment defined produces a harmonious motion largely simulating a natural walking motion, which significantly improves the performance of the user. Furthermore, a shoe sole that is relatively stable in shape can be used, thereby producing an optimum, immediate transfer of energy to the ground, generating an efficient forward motion.

The embodiment outlined leaves sufficient play for a rolling motion of the sport shoe across the rolling body without having to deform the actual shoe or shoe sole, right from the initial phase of the upward pivoting motion.

With the embodiment described, the shoe tip region can be simultaneously displaced in the direction towards the sports device during the upward pivoting motion, counteracting any tilting motion of the sports device about its longitudinal axis relative to the sport shoe during kickoff, so that the kicking energy is transferred as far as possible without loss.

As a result of the embodiments described, the sport shoe is held firmly on the sports device at the sides. Furthermore, because the strip-shaped binding system surrounds all sides, the risk of the binding system buckling is minimised and any jerking movement of the sport shoe relative to the longitudinal direction of the sports device is effectively prevented.

Also of advantage is an embodiment of the type described, whereby the sports device is able to achieve at least a linear contact without the need for additional measures and prevents the formation of any detrimental air gaps.

The preferred embodiment provides the most varied of damping characteristics during the upward pivoting motion and exhibits a constant tendency to return to a defined initial position.

Relatively high damping forces or high pivoting resistance can be generated in a simple manner due to the embodiment outlined.

The embodiment described counteracts any tendency of the sport shoe to lift from the sports device when pivoting about the ideal axis formed by the binding element.

A compact design of the spring means is provided as a result of the embodiment outlined.

Lifting movements of the shoe tip region from the sports device are also prevented even when the user is leaning backwards, due to the embodiment described.

Other advantageous embodiments of binding elements which are deformable on one side or have limited deformation capacity are set out.

The preferred embodiment advantageously causes a relative displacement between the tread surface or sport shoe and the sports device joined to it with every upward pivoting movement of the sport shoe relative to the sports device in the longitudinal direction thereof or in the direction of the usual forward movement or direction of travel, lengthening the strides accompanying the upward pivoting motion to enhance performance.

Also of advantage is another embodiment, since it always forces the sports device into a defined initial or rest position relative to the sport shoe.

The advantage of the embodiment described is that the lever can be accurately guided and is capable of withstanding high forces. Kinematically detrimental lever positions can also be prevented due to the fact that the pivoting motion is restricted.

Another advantageousembodiment is described whereby every upward pivoting motion of the sport shoe relative to the sports device simultaneously results in a relative displacement between sport shoe and sports device in the longitudinal direction of the sports device, thereby producing a mechanical lengthening of the stride.

The invention also relates to a shoe of the type, where the shoe is characterised by the features described herein. The resultant advantages can be found in the detailed description of the drawings.

The present invention also relates to a sports device, as described in the claims. this sports device is characterised by the features claimed. The resultant advantages can be found in the detailed description of the drawings.

In order to provide a clearer understanding, the invention will be described in more detail below with reference to the appended drawings.

Of these:

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, individual features or combinations of features from the different embodiments illustrated and described may be construed as independent inventive solutions or solutions proposed by the invention in their own right.

Figure 1:
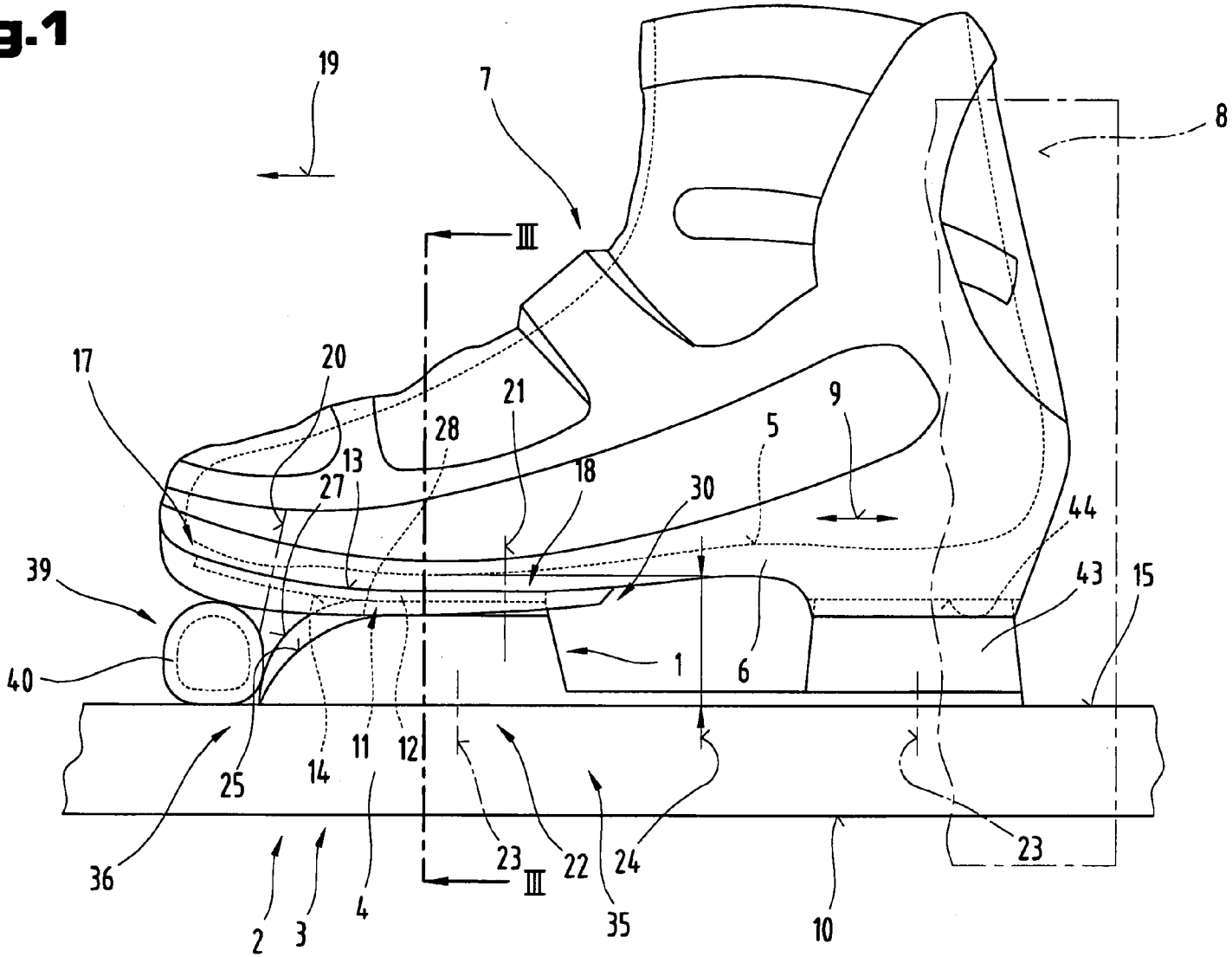
FIG. 1 is a very simplified, schematic diagram of a binding system as proposed by the invention for retaining a user on a sports device, seen from a side view.
Figure 2:
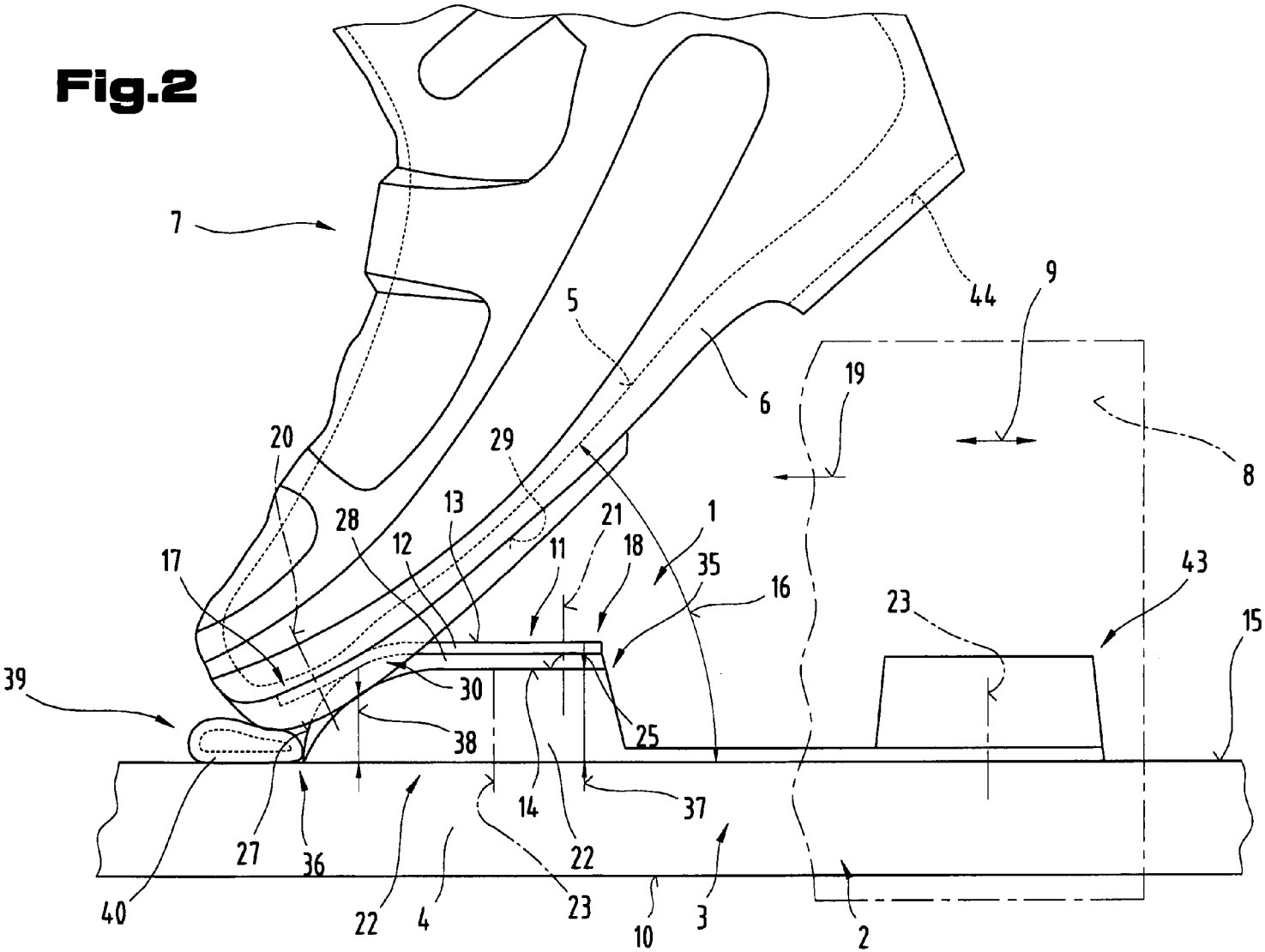
FIG. 2 is a very simplified, schematic diagram of the binding system illustrated in FIG. 1 with the sport shoe pivoted upwards, e.g. during kickoff from the ground.
Figure 3:
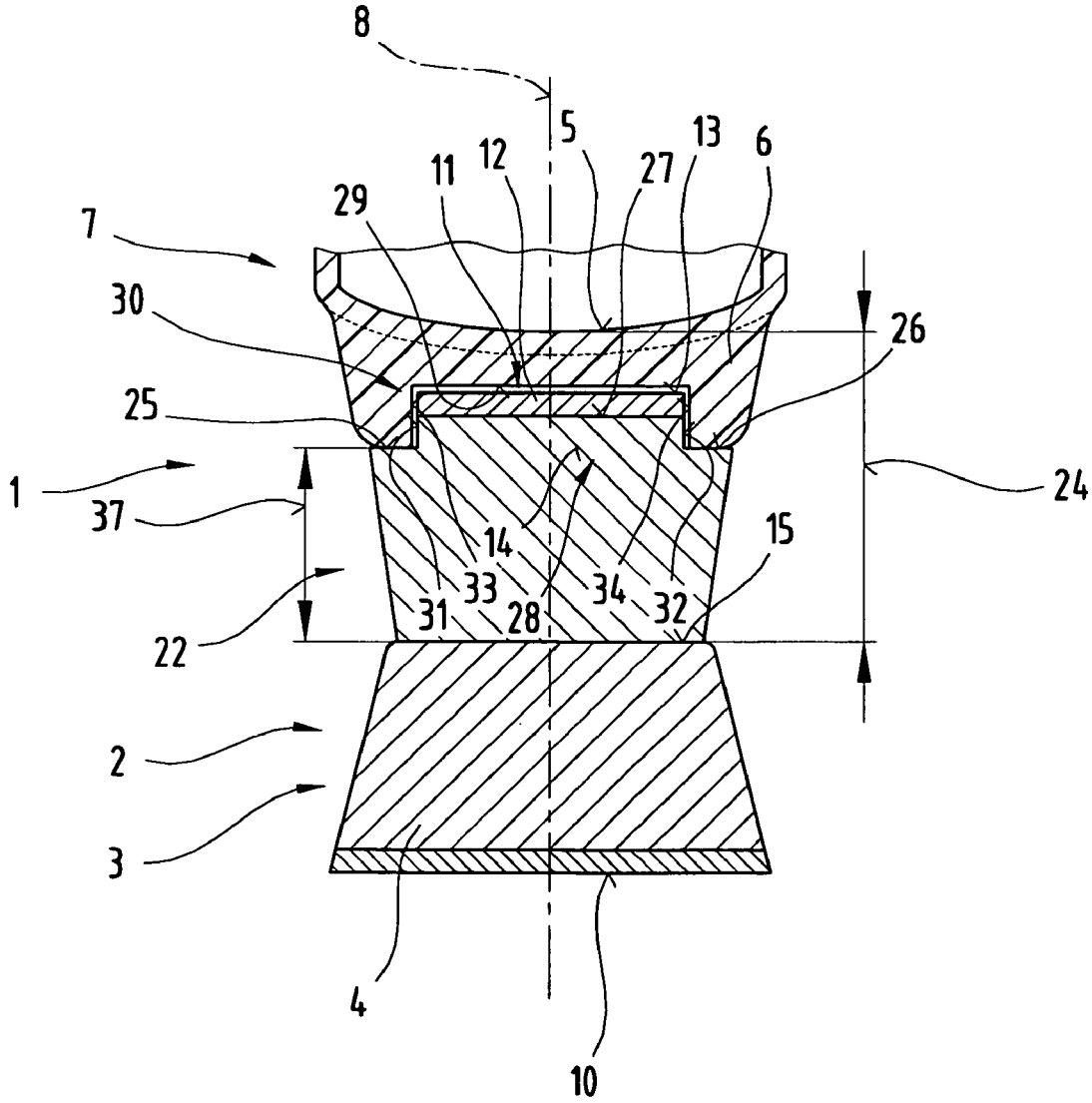
FIG. 3 is a cross section of the binding system along the lines III—III of FIG. 1.

FIGS. 1 to 3 illustrate one embodiment of a binding system 1 as proposed by the invention, between a sports device 2 in the form of a sliding or rolling member 3, such as a ski 4 or a roller-skate for example, and a tread surface 5 for a user's foot. The tread surface 5 for the user's foot is preferably a shoe sole 6 of a sport shoe 7.

Alternatively, the tread surface 5 for the user's foot may also be a separate, contoured, largely non-deformable bearing element, designed to support or releasably receive the sport shoe 7.

The binding system 1 can be used with a whole variety of sports devices 2. In particular, the binding system 1 is suitable for joining appropriate sport shoes 7 to skis for cross-country skiing or touring sports. Similarly, the binding system 1 may be used with ice skating boots and/or with single or multi-track roller-skates. This being the case, the term sports device 2 should be read as meaning a skating blade or single- or multi-track rollers or a retaining frame for rollers. Sports devices of this type are also known as folding ice skates or folding roller skates.

The sport shoe 7 or the tread surface 5 for the user's foot is able to pivot relative to the sports device 2 about an imaginary or ideal axis, running perpendicular to a vertical plane 8. This imaginary vertical plane 8 extends in the longitudinal direction—double arrow 9—and is also aligned substantially perpendicular to the tread surface 5 for the foot. Relative to the sports device 2, the vertical plane 8 therefore runs parallel with the longitudinal extension thereof and is substantially perpendicular to a running surface 10 of the sports device 2.

The binding system 1 forming an ideal pivot axis has at least one binding element 11, which, in the embodiment illustrated as an example here, is the only member binding the sport shoe 7 to the sports device 2.

The binding element 11 is elastically and resiliently deformable in the vertical plane 8. In particular, when projecting onto the vertical plane 8 or as viewed in a direction perpendicular to the vertical plane 8, the binding element 11 is variable in shape in this plane.

The flexible binding element 11 between the tread surface 5 and the sports device 2 preferably consists of a resilient, return spring of a leaf design 12 made from a metal material, such as spring steel.

The two broad sides 13, 14 of the strip-shaped binding element 11 are aligned substantially parallel with the tread surface 5 when the binding system 1 is in the rest or initial position illustrated in FIG. 1. In this rest or initial position illustrated in FIG. 1, a pivot angle 16 subtended by the tread surface 5 and the running surface 10 or a top face 15 of the sports device 2 is approximately 0°, i.e. the tread surface 5 and the running surface 10 or top face 15 of the sports device 2 are aligned substantially parallel with one another.

When the heel region of the sport shoe 7 is pivoted upwards from the sports device 2 about the ideal axis formed by the strip-shaped binding element 11, the pivot angle 16 becomes wider and can reach as much as 90°, but is usually up to 45°.

The strip-shaped resilient binding element 11 is naturally of width which is a multiple of the height or thickness of the strip-shaped binding element 11. Accordingly, the binding element 11 or the leaf spring 12 can be deformed relatively easily when force is applied in a direction perpendicular to the two broad sides 13, 14 thereof and returns to the initial or rest position due to the inherent elasticity of the binding element II when pressure is released. In the initial or rest position, the binding element II or leaf spring 12 preferably assumes a straight, longitudinally extending shape.

The binding element 11 is also designed to be largely resistant to expansion and shrinkage. These properties can be easily imparted by using a metal strip of an appropriate thickness or corresponding elasticity or strength.

In a simple but advantageous manner, the binding element 11 has a high bending strength relative to the deformation forces produced about a vertically extending axis, due to the strip-shaped design of the binding element 11 made from metal materials and/or elastically resilient synthetic materials. The very fact of providing the binding element II as a leaf spring gives the tread surface 5 a high resistance to twisting about a vertical axis relative to the sports device 2.

The leaf spring 12 or the corresponding binding element 11 extending in the longitudinal direction—double arrow 9—of the tread surface 5 or the sports device 2 is joined in the end regions 17, 18, relative to the longitudinal direction, to the tread surface 5 or shoe sole 6 on the one hand and to the sports device 2 on the other. In particular, the front end region 17 relative to the usual direction of travel—arrow 19—of the sports device 2 is joined to the shoe sole 6 and the rear end region 18 of the binding element 11 is joined to the sports device 2.

As an alternative, it would clearly also be possible for the front end region 17 relative to the longitudinal direction—double arrow 9—to be fixed to the sports device 2 and the rear end region 18 relative thereto to be joined to the sport shoe 7.

This connection may be releasable, if necessary, or non-releasable. Accordingly, the binding element 11 may be screwed or riveted to the shoe sole 6 or the sports device 2 by the schematically illustrated fixing means 20, 21, or alternatively bonded thereto. The binding element 11 or the leaf spring 12 may also additionally or exclusively be joined to the respective components in a positive fit at the end regions 17, 18. Furthermore, the binding element 11 may be injection-moulded or integrated in the shoe sole 6 or the sports device 2, or in an additional component of the binding system 1 fulfilling a mounting or supporting function, during the manufacturing process or anchored thereon subsequently.

All known fixing or connection methods may be used. The crucial factor is to ensure that the binding element 11 or leaf spring 12 is joined by its end regions 17, 18 exclusively to the shoe sole 6 or the sports device 2 and the central region lying in between is left unsecured or unfixed, permitting the binding element 11 to deform free of tension when the sport shoe 7 is pivoted up form the sports device 2.

In particular, a two-point fixing is provided, in which the first binding point is disposed between the first end region 17 of the binding element 11 and the tread surface 5 or shoe sole 6 and the second binding point is between the second end region 18 of the binding element 11 and the sports device 2 or an additional rolling body 22 on the sports device.

In order to produce a harmonious, energy-optimised lifting and/or pivoting movement of the sport shoe 7 about the ideal axis relative to the sports device 2, the rolling body 22 between the tread surface 5 or shoe sole 6 and the top face 15 of the sports device 2 is preferably disposed in a section of the sole underside corresponding to the ball of the foot and is joined to the sports device 2 in a positive and/or force fit, e.g. screwed, bonded or snap-fit on the sports device 2 or made in a single piece therewith.

In the embodiment illustrated as an example here, the rolling body 22 is screwed onto the sports device 2, in particular the ski 4, with fixing means 23.

As a result of the position in which it is integrated, this rolling body 22 supports the tread surface 5 or the shoe sole 6 at a vertical distance 24 above the top face 15 of the sports device 2.

The rolling body 22 by means of which the shoe sole 6 is supported on the sports device 2 has at least one arcuately curved rolling surface 25, 26 for the shoe sole 6. These rolling surfaces 25, 26 preferably extend in the longitudinal direction of the sports device 2 or the tread surface 5 and are aligned, at least in a part region, substantially parallel with the tread surface 5.

By preference, two rolling surfaces 25, 26 are provided at a distance apart from one another perpendicular to the vertical plane 8, primarily co-operating with the longitudinal side regions of the shoe sole 6 providing support for it. Disposed between the two longitudinal side regions of the sports device 2 and the rolling surfaces 25, 26 extending in the longitudinal direction thereof, another rolling surface 27 is preferably provided, which predefines the rolling curve or deformation of the binding element 11 or leaf spring 12 when the sport shoe 7 is pivoted upwards.

The centre rolling surface 27 for the binding element II is arranged higher than the two side rolling surfaces 25, 26 for the shoe sole 6.

Viewed in cross section—as illustrated in FIG. 3—the shape of the rolling body 22 is substantially rectangular in contour having a centrally disposed projection 28 to form the rolling surface 27.

The centre projection 28 between the rolling surfaces 26, 27 on the rolling body 22 engages in a positive fit in a groove-shaped recess 29 in the shoe sole 6. In particular, the projection 28 and the complementary recess 29 in the shoe sole 6, displaceable so as to mutually engage, have a lateral guide device 30 which prevents any lateral deviation of the sport shoe 7 relative to the sports device 2 or relative to the binding system 1. In addition to preventing movements perpendicular to the vertical plane 8 between the sport shoe 7 and the sports device 2 or rolling body 22 or the binding system, the lateral guide device 30 also counteracts rotating movements about a vertical axis between the sport shoe 7 and the sports device 2.

The rolling body 22 of the binding element 1 therefore assumes a support and guide function for the sport shoe 7 relative to the sports device 2 so that the correct movement for efficient forward motion with the sports device 2 is achieved.

The lateral guide device 30 of the binding system 1 or the rolling body 22 comprises in particular vertical side faces 31, 32 of the projection 28 co-operating with side walls 33, 34 of the groove-shaped recess 29. When the binding system 1 is in the ready-to-use state, at least part regions of the side faces 31, 32 of the projection 28 lie substantially without any clearance against the approximately vertically upright side walls 33, 34 of the groove-shaped recess 29 in the shoe sole 6.

To provide accurate guidance between the sport shoe 7 and the sports device 2 or the rolling body 22 for a longer time, the side walls 33, 34 or the side faces 31, 32 may taper towards one another in a conical arrangement, in a vertical direction starting from the sports device 2 as viewed in cross section—as illustrated in FIG. 3. The side walls 33, 34 of the recess 29 are therefore able constantly to apply a certain abutment pressure to produce a clearance-free fit against the side faces 31, 32 of the projection 28.

At the same time, the lateral guide device 30 between the shoe sole 6 and the rolling body 22 therefore provides a guiding function which is as far as possible friction-free. This can be achieved by a judicious selection of materials exhibiting the requisite friction coefficients. By preference, the material used for the rolling body 22 or the shoe sole 6 is a hard plastics with as smooth as possible a surface. Optionally, at least the side faces 31, 32 and/or the side walls 33, 34 may be provided with a friction-reducing coating, e.g. in the form of a Teflon or anti-friction coating.

The rolling surfaces 25 to 27, on which the shoe sole 6 or the binding element 11, made of spring steel, for example, roll on the sports device 2 in a predefined manner when the sport shoe 7 is lifted extend, starting from an initial region 35 of the rolling body 22 relative to the usual direction of travel—arrow 19—in the direction towards a front end region 36 of the rolling body 22 and increasingly in the direction towards the sports device 2 or increasingly in the direction towards the top face 15 of the sports device 2, i.e. a support height 37 of the rolling body 22 relative to the top face 15 of the sports device 2 decreases progressively in the direction towards the front region of the sports device 2 or progressively in the direction towards the toe region of the tread surface 5. A support height 38 in the front end region 36 of the rolling body 22 is therefore only a fraction of the support height 37 in the initial region 35 of the rolling body 22. In particular, the support height 38 progressively decreases to zero in the direction of movement or travel—arrow 19—of the sports device 2.

In particular, starting from a region of the tread surface 5 adjacent to the heel, the rolling surfaces 25 to 27 extend in the direction towards a region of the tread surface 5 co-operating with the toes and increasingly in the direction towards the running surface 10 or top face 15 of the sports device 2.

Consequently, the rolling surfaces 25, 26 disposed on either side of the centre rolling surface 27 arranged on a higher level form a downwardly extending contact path for the shoe sole 6 and the centre, higher rolling surface 27 forms a curved contact path extending downwards in the direction towards the sports 2 device for the flexible binding element 11.

Projecting onto the vertical plane 8, the rolling surfaces 25, 26, 27 have a convex curvature relative to the top face 15 of the sports device 2. The radii of curvature of the rolling surfaces 25, 26 may be different from the radius of curvature of the rolling surface 27, in particular larger. The differing radii of curvature of the rolling surfaces 25 to 27 depend on optionally varying depths of the groove-shaped recess 29 in the longitudinal direction—double arrow 9—of the tread surface 5. Optionally, the rolling surfaces 25 to 27 are shaped so that, in spite of varying depth dimensions of the recess 29 in the shoe sole 6, an almost linear contact is established between the rolling surfaces 25 to 27 or between the rolling surfaces 25, 26 and the underside of the shoe sole 6 in as many pivot angles 16 as possible.

The centre rolling surface 27 specifically forms a contact surface for the leaf-spring binding element 11 and the rolling surfaces 25, 26 disposed on either side of the rolling surface 27 form a contact surface for the rolling motion of the shoe sole 6 when the sport shoe 7 is pivoted.

The deformation resistance of the flexible binding element 11 or the leaf-spring 12 is preferably dimensioned so that the gravitational force acting via the sports device 2 on the leaf-spring 12 when the sports device 2 is raised from the ground permits at most a slight deformation of the binding element 11. Consequently, the sports device 2 can not essentially move apart from the sport shoe 7 or from the shoe sole 6 when lifted up off the ground. The sports device 2 or the rolling body 22 therefore sit largely clearance-free against the shoe sole 6 when the foot is merely raised off the ground, provided there are no additional forces such as extraordinary centrifugal forces or inertial forces. The flexibility or deformation resistance of the binding element 11 or leaf spring 12 can be adjusted by a judicious choice of thickness, shape or material and adapted to requirements as appropriate.

An appropriate choice of the weight distribution or mounting point of the binding system 1 on the sports device 2 can also prevent the sports device 2 from pivoting relative to the sport shoe 6 or tread surface 5 when lifted off the ground. This can be achieved by making the front part region of the sports device 2 relative to the direction of travel—arrow 19—heavier than the rear part region of the sports device 2 relative to the direction of travel—arrow 19—starting from the mounting point of the binding system 1. An appropriate choice of deformation resistance or flexibility of the leaf spring 12 can also counteract any undesirable pivoting of the sports device 2 relative to the sport shoe 7.

Accordingly, the deformation resistance of the leaf spring 12 is approximately 10 N in relatively lightweight sports devices 2 and up to 100 N in heavier sports devices 2.

However, the deformation resistance should also be dimensioned so that it can be readily overcome by the user's foot if the tread surface 5 is intentionally lifted relative to the sports device 2.

The return capacity of the strip-shaped, flexible binding element 11 or leaf spring 12 may optionally be further assisted by providing an elastically returnable spring means 39. This spring means 39 is designed and disposed so that it applies a mechanical resistance which can be overcome by the user's foot against the upward pivoting movement of the tread surface 5 relative to the sports device 2 and pushes the tread surface 5 into the initial or rest position illustrated in FIG. 1 provided no force is applied by the user's foot. The spring means 39 may be provided in the form of an elastically flexible and resilient damping body 40 when pressure is applied, in particular made from an elastomeric synthetic material. This damping body 40, designed to absorb compression stress, is disposed in particular in the region of the tread surface 5 co-operating with the toes, between the underside of the shoe sole 6 and the sports device 2 so that the upward pivoting movement of the sport shoe 7 applies an opposing mechanical, preferably constantly increasing resistance.

Figure 4:
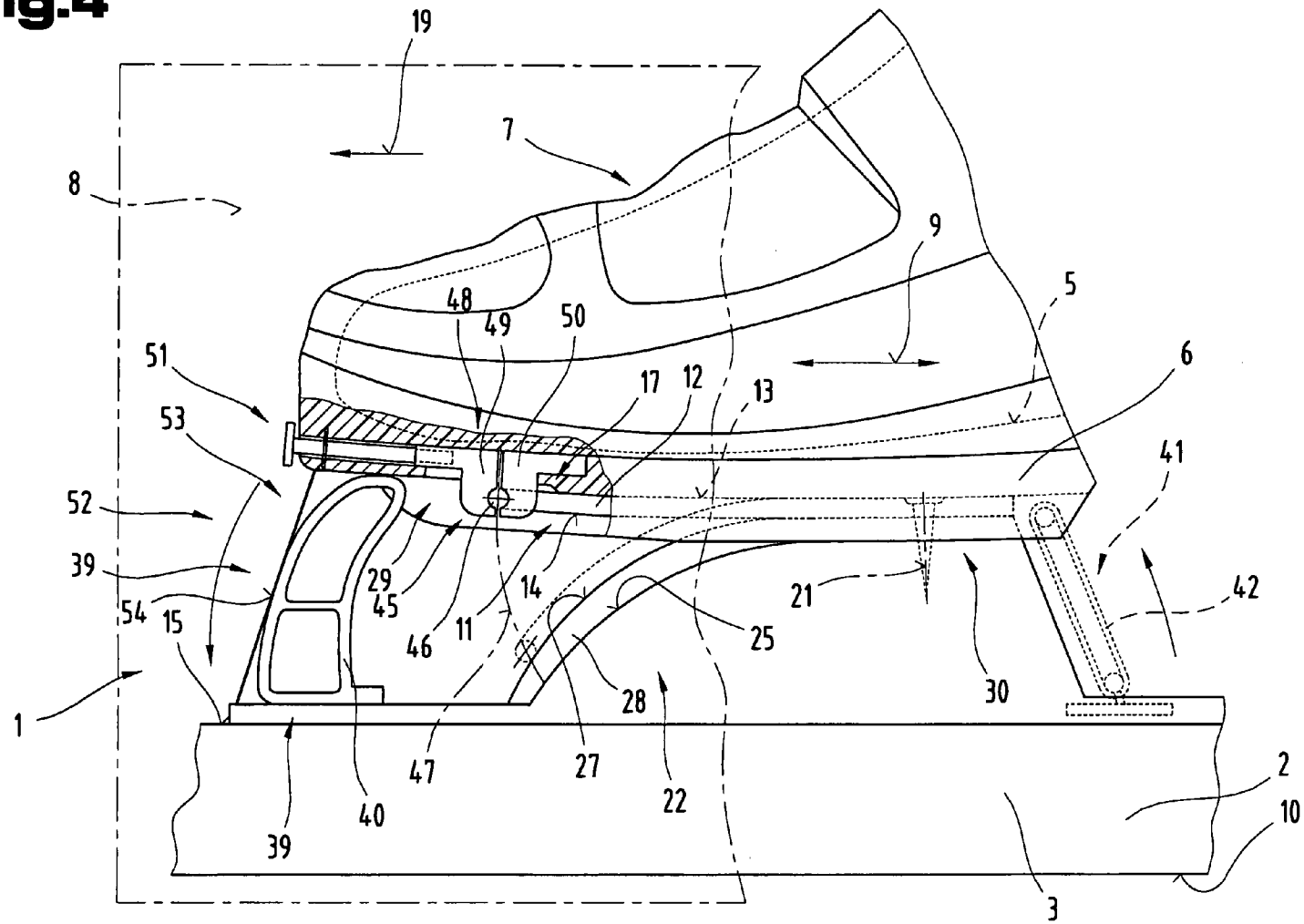
FIG. 4 is a very simplified, schematic diagram of another embodiment of the binding system proposed by the invention between a sport shoe and a sports device, having an additional hinge mechanism between the sport shoe and the binding element.

Similarly, a spring means 41 may be provided, as illustrated by broken lines in FIG. 4, which is designed to apply a defined deformation resistance against tensile stress and is specifically provided in the form of an elastically resilient tension band 42 made from an elastomer synthetic material. This elastically resilient tension band 42 would then be arranged, relative to the direction of movement or travel—arrow 19—in front of the binding point between the binding element 11 and the shoe sole 6 between the latter and the sports device 2. In particular, the spring means 41 or tension band 42 provided as a means of absorbing tensile stress is joined on the one hand to the shoe sole 6 and on the other to the sports device 2 or is secured to a component of the binding system 1.

The spring means 41 or tension band 42 may be provided as an alternative to the damping member 40 or may be combined with it.

The spring means 39, 41 may be hollow bodies, in particular damping cushions, to enable a relatively large damping path, as illustrated in FIGS. 1 and 2 in particular. As will be explained in more detail below, the spring means 39, 41 may also be provided as damping members 40 of a hollow section type or damping members 40 with slots in the circumferential region.

The additional spring means 39, 41 can be provided as an option if the flexibility of the leaf spring 12 is selected accordingly.

Returning to FIGS. 1 to 3, a guide member 43 is preferably provided in the heel region of the tread surface 5 or shoe sole 6 between the latter and the sports device 2, which co-operates with the shoe sole 6 to prevent a relative displacement between the sport shoe 7 and the sports device 2 in the vertical direction towards the vertical plane 8 when the sport shoe 7 is lying against the sports device 2 in the heel region. In particular, when the sport shoe 7 is placed against the sports device 2, the guide member 43, immovably mounted on the sports device 2, co-operates with a recess 44 in the heel or heel region of the shoe sole 6 and extending in the longitudinal direction of the tread surface 5 so that lateral deflections are prevented when the guide member 43 is engaged in the recess 44.

FIG. 4 illustrates another embodiment of the binding system 1 proposed by the invention, in which parts already described above are denoted by the same reference numbers.

Unlike the embodiment illustrated in FIGS. 1 to 3, this binding element 11 is by and large rigidly bound to the tread surface 5 or shoe sole 6 but is joined to the tread surface 5 or shoe sole so that it can pivot by means of a hinge mechanism 45. The hinge mechanism 45 between the shoe sole 6 and the end region 17 of the binding element II co-operating therewith forms a pivot axis 46 perpendicular to the vertical plane 8. This pivot axis 46 enables the tread surface 5 or sport shoe 7 to pivot relative to the binding element II or relative to the sports device 2. The pivot axis 46 formed by the hinge mechanism 45 extends substantially parallel with the tread surface 5 and substantially transversely to the longitudinal direction—double arrow 9—of the sports device 2 or the tread surface 5. As a result of the hinge mounting between the shoe sole 6 and the strip-shaped flexible binding element 11, a pivot axis 46, variable in height in the vertical direction relative to the sports device 2, is formed. This pivot axis 46 which can be varied in height in the vertical plane 8 by means of the flexible binding element II promotes the rolling action of the sport shoe 7 on the sports device 2 to produce as natural a movement as possible. In addition to the pivoting movement of the sport shoe 7 on the sports device 2 made possible by the flexible binding element 11, further play is provided in the form of another pivoting option by means of the additional hinge mechanism 45.

The pivot axis 46 travels on a circular course 47 in the direction towards the sports device 2 defined by the rolling surfaces 25 to 27 and the elasticity of the binding element 11 when pressure is duly applied to the tread surface 5 by the user's foot in a specific phase of the cycle of forward motion. In particular, the front toe region of the sport shoe 7 or tread surface 5 moves closer to the sports device 2 as vertical pressure is applied to the region co-operating with the toes or the ball of the foot and the heel region is lifted and rolls on the rolling body 22 in a defined manner.

A corresponding opposing force can be applied to these rolling movements by disposing the spring means 39 and/or 41 between the underside of the shoe sole 6 and the top face 15 of the sports device 2.

An optionally releasable coupling device 48 is preferably provided on the sports device 2 between the sport shoe 7 or the shoe sole 6 thereof and the binding system 1. The sport shoe 7 can be released or bound from or to the binding system 1 or sports device 2 by means of this coupling device 48, as required. Any known fast coupling systems which are preferably manually operated without the assistance of tools may be used for this coupling device 48.

For example, the coupling device 48 may be provided in the form of at least two bearing jaws 49, 50 which are displaceable relative to one another. The bearing jaws 49, 50 can be displaced relative to one another by means of an operating member 51 which is operatively connected to at least one of the bearing jaws 49, 50. The operating member 51 may be a threaded spindle arrangement with an associated screw nut, for example, by means of which at least one of the bearing jaws 49, 50 is linearly displaced when the operating member 51 is turned. The bearing jaws 49, 50 form a seat for a pivot pin which is fixed to the binding element 11 at the end region 17 thereof. The bearing jaws 49, 50 are preferably integrated in the shoe sole 6 or are secured thereto. By preference, the bearing jaws 49, 50 are arranged in the recess 29 of the shoe sole 6 and do not project beyond an underside of the shoe sole 6 so that when the sport shoe 7 is separated from the sports device 2 it can be used for walking with as little hindrance as possible.

In the rear end region 18 relative to the direction of forward movement—arrow 19—the binding element 11 is rigidly secured to the top face of the rolling body 22.

In addition to appropriate dimensioning of the flexible binding element II to avoid deflections between the sport shoe 7 and the sports device 2 when the foot is lifted off the ground, a binding element 11 with a limited deformability may be used in order to produce a continuous bearing for the sport shoe 7 on the sports device 2. In particular, this binding element 11 of limited deformability is deformable in a vertical direction starting from the sports device 2 but not beyond a defined deformation limit. This deformation limit may be defined by the longitudinally extending shape of the strip-shaped binding element 11, for example. To this end, the binding element 11 may be provided in the form of a link strip, for example, having members which pivot in a vertical direction starting from the top face 15 of the sports device 2 and restricted by stops. Starting from a substantially longitudinally extended position, this link strip can also be displaced in the direction towards the sports device 2 to assume a curved position and back again. In order to return to the almost extended position or initial position illustrated in FIG. 1 or FIG. 4, this link strip may co-operate with the resilient leaf spring 12. In particular, the individual members acting as abutment stops may be pushed on the leaf spring 12 to prevent deformation beyond a specific abutment stop, e.g. beyond the longitudinally extended configuration, thereby preventing the sport shoe 7 from lifting off the sports device 2.

Another anti-lift mechanism 52 may also be provided in the form of a tension-resistant securing element 53 to prevent the sport shoe 7 from lifting off the sports device 2. This securing element 53 is joined to the sports device 2 on the one hand and to the tread surface 5 or shoe sole 6 on the other and is dimensioned so that when the sport shoe 7 assumes the initial or rest position relative to the sports device 2 it is stretched or longitudinally extended. This securing element 53 may be a tension-resistant but non-shrinkable or foldable band 54, e.g. made from a textile material or similar. Similarly, the securing element 53 may be provided by at least two levers joined to one another in a pivot configuration at facing end regions, the ends remote from the common pivot axis being joined to the sports device 2 or the shoe sole 6. A configuration of this type might be described as a toggle joint.

Figure 5:
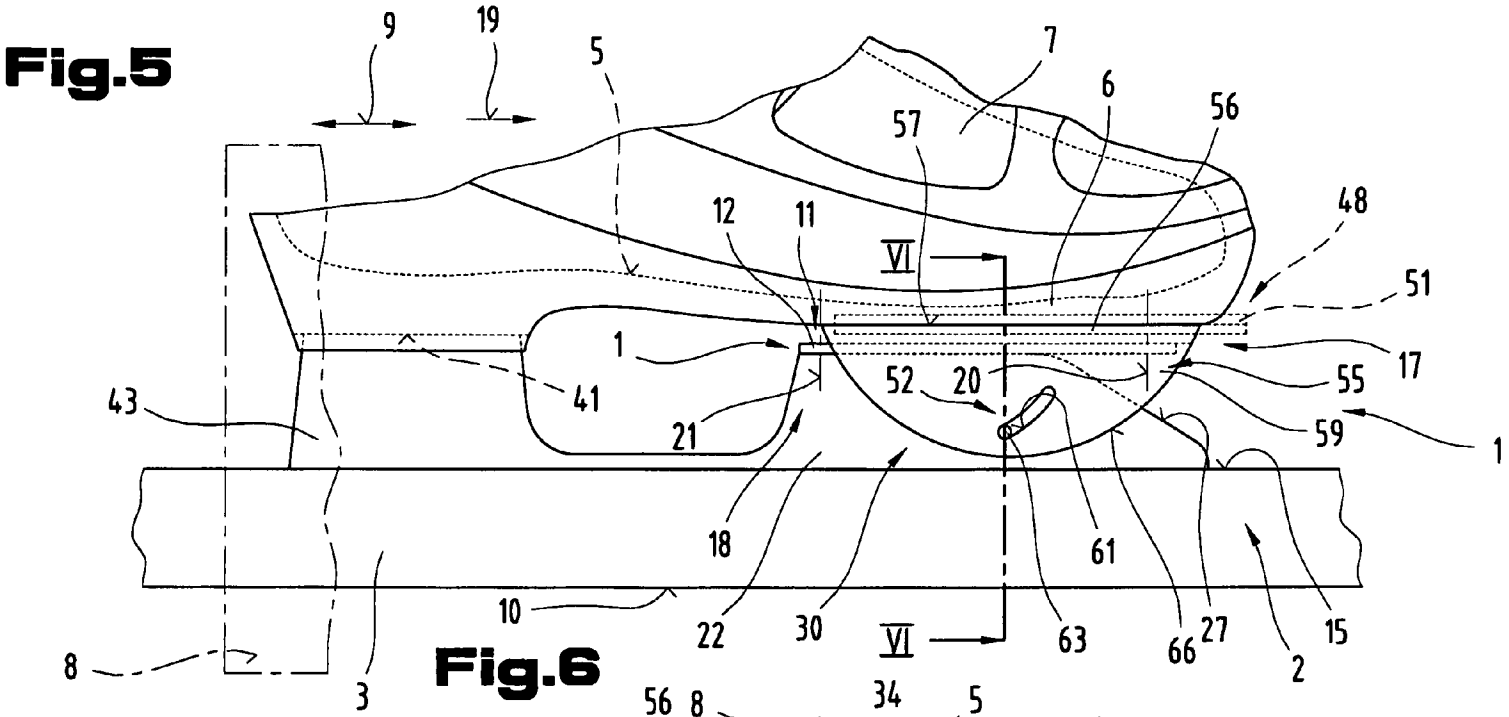
FIG. 5 is a very simplified, schematic diagram of another embodiment of the binding system between a sport shoe and a sports device, seen from a side view.
Figure 6:
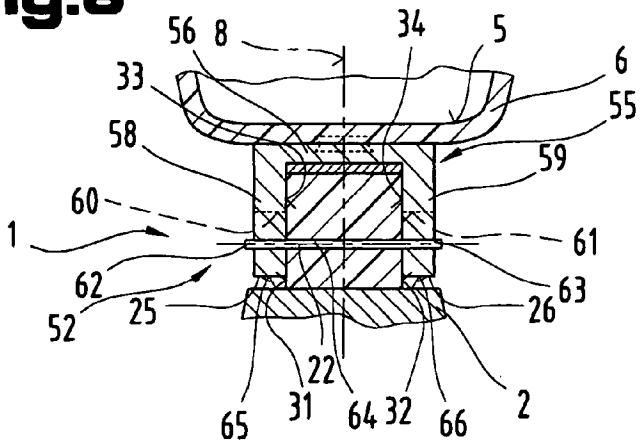
FIG. 6 is a cross section of the binding system illustrated in FIG. 5, along the lines VI—VI of FIG. 5.

FIGS. 5 and 6 illustrate another embodiment of the binding system 1 proposed by the invention, in which parts already described above are shown by the same reference numbers.

In this case, the lateral guide device 30 between the sport shoe 7 and the sports device 2 has a separate guide element 55, which co-operates with the rolling body 22 immovably fixed to the sports device 2 to form the lateral guide device 30.

The guide element 55 provided as a separate component is provided as a binding means to the shoe sole 6. In particular, the guide element 55 is provided with a mounting plate 56, the top face 57 of which is joined to the underside of the shoe sole 6. The substantially horizontally aligned mounting plate 56 can be releasably connected to the shoe sole 6 by providing a corresponding coupling device 48. This coupling device 48 may comprise any known connecting members capable of displacing the shoe sole 6 and the mounting plate 56 by a translatory and/or rotary movement into and out of a positive-fit engagement. As a result, the sport shoe 7 can be readily separated from the sports device 2 or from the binding system 1 as required and the user can walk away as required without the sports device 2.

The guide element 55 of the binding system 1 has at least two side plates 58, 59 spaced at a distance apart from another and projecting from the mounting plate 56 in the direction towards the top face 15 of the sports device 2. The inner side walls 33, 34 of the side plates 58, 59 facing one another abut with virtually no clearance against the side faces 31, 32 of the rolling body 22. The inner side walls 33, 34 of the guide element 55 therefore lie with virtually no clearance and with as large as surface area as possible against the side faces 31, 32 of the rolling body 22. The side faces 31, 32 and side walls 33, 34 extend parallel with the vertical plane 8.

The guide element 55 therefore has a U-shaped cross section and spans the rolling body 22 at least partially with the mounting plate 56 and the two side plates 58, 59. In particular, the at least partially enclosed free space between the side plates 58, 59 is provided as a means of receiving the rolling body 22.

The strip-shaped, flexible or resiliently deformable binding element 11 is provided as a means of joining the guide element 55 to the rolling body 22. In particular, the binding element 11 or leaf spring 12 is joined at the end regions, relative to the longitudinal direction—double arrow 9—to the rolling body 22 on the one hand and the guide element 55 on the other. Specifically, the front end region 17 of the binding element 1 relative to the usual direction of movement or travel—arrow 19—is immovably fixed to the underside of the mounting plate 56 and the second end region 18 of the binding element 11 spaced at a distance apart is immovably joined to the rolling body 22. The fixing means 20, 21 described above may be used for the two joining points spaced at a distance apart.

The strip-shaped binding element 11 primarily prevents any relative displacement between the rolling body 22 and the guide element 55 in the longitudinal direction—double arrow 9—of the sports device 2 but still permits pivoting movements of the guide element 55 or the sport shoe 7 relative to the rolling body 22 or relative to the sports device 2 about an ideal pivot axis 46 perpendicular to the vertical plane 8.

This binding system 1 also has a different embodiment of the anti-lift mechanism 52. In this case, the anti-lift mechanism 52 consists of at least one arcuately curved guide slot 60, 61 which co-operates with at least one projection 62, 63.

By preference, the projection 62, 63 co-operates with the rolling body 22 and engages in the arcuate guide slots 60, 61 provided in the side plates 58, 59. In particular, pin-type projections 62, 63 are provided on the side faces 31, 32 of the rolling body 22 which engage in the arcuate guide slots 60, 61 extending in the side plates 58, 59.

By preference, the projections 62, 63 are provided as a guide pin 64 which extends through the two side plates 58, 59 as well as the rolling body 22 in a direction perpendicular to the vertical plane 8.

When the binding system 1 is in the initial or rest position illustrated in FIGS. 5 and 6, the projections 62, 63 lie at the bottom end of the guide slots 60, 61 preventing the guide element 55 from being lifted from the rolling body 22 but allowing it to pivot about the ideal pivot axis. A centre point of the arcuately curved guide slots 60 lies in the vertical plane 8 above the top face 15 of the sports device 2. In particular, an imaginary centre point of the arcuate or curved guide slots 60, 61 relative to the vertical plane 8 is higher than the recesses in the side plates 58, 59 forming the guide slots 60, 61.

Optionally, the guide slots 60, 61 may also be disposed as in the embodiment indicated by broken lines. In this case, an imaginary centre point of the curved or arcuate guide slots 60, 61 relative to the vertical plane 8 is arranged lower than the recesses in the side plates 58, 59 forming the guide slots 60, 61.

In the embodiment illustrated as an example here, the rolling surface 27 constitutes the rolling path for the binding element 11 and for the guide element 55 or sport shoe 7 and no other curved rolling surfaces 25 to 27 are provided on the rolling body 22.

Optionally, the bottom edges 65, 66 of the side plates 58, 59 may be supported on the top face 15 of the sports device 2. In an embodiment of this type, the bottom edges 65, 66 have an arcuate contour to prevent an unhindered pivoting movement and to support the guide element 55 on the top face 15 of the sports device 2. In this case, the side plates 58, 59 assume the role of the rolling surfaces 25, 26 described above.

The invention claimed is:

1. Pivotable binding system (1) for mounting between a sports device (2) and a tread surface (5) for a user's foot, with which binding system (1) the tread surface (5) is pivotable about an axis extending almost parallel with the ankle joint of the foot and with which binding system (1) the tread surface (5) is displaceable in the front-part-region cooperating with the ball of the foot to a position closer to the sports device (2) by means of a rolling body (22)

provided between the tread surface (5) and the sports device (2) in the region co-operating with the ball of the foot and forming a curved rolling surface (25; 26; 27) which supports the tread surface (5) at a vertical distance (24) above a top face (15) of the sports device (2), and which rolling surface (25; 26; 27) starts from a region of the tread surface (5) lying closer to the heel of a foot in a direction towards the toe region of the tread surface (5) and also curved downwards in a direction towards the top face (15) of the sports device (2), and having a binding element (11) that is flexible and resiliently deformable in a vertical plane (8), by means of which binding element (11) the tread surface (5) can be articularly joined to the sports device (2), and which flexible and resiliently deformable binding element (11) forms the pivotable connection between the tread surface (5) and the sports device (2), and with a lateral guide device (30) acting between the tread surface (5) and the rolling body (22) in order to prevent displacements in a direction perpendicular to the vertical plane (8) and to prevent twisting movements about an axis extending in a vertical direction between the tread surface (5) and the sports device (2).

2. Pivotable binding system as claimed in claim 1, wherein the lateral guide device (30) is provided as a groove-shaped recess (29) in the shoe sole (6) extending in a longitudinal direction-(9)-of the tread surface (5) and a projection (28) on the sports device (2) co-operating with this recess (29).

3. Pivotable binding system as claimed in claim 1, wherein the binding element (11) is strip-shaped but resistant to expansion and shrinkage and, at end regions (17, 18) spaced apart from one another in the longitudinal direction (9) of the tread surface (5) for the foot, and is immovably secured respectively to (i) a shoe sole (6) forming the tread surface (5) and to (ii) the sports device (2).

4. Pivotable binding system as claimed in claim 1, wherein the binding element (11) in the end region (18) cooperates with the sports device (2 ) and is rigidly joined thereto and the binding element (11) in the opposite end region (17) cooperates with the tread surface (5) and is joined to the latter by a hinge mechanism (45).

5. Pivotable binding system as claimed in claim 4, wherein an elastically resilient spring member cooperates with the hinge mechanism (45) pivotably joining the shoe sole (6) to the binding element (11), in particular in the form of a torsion spring, which applies a mechanical resistance against the upward pivoting movement of the tread surface (5) relative to the sports device (2), which can be overcome by the user's foot.

6. Pivotable binding system as claimed in claim 1, wherein the binding element (11) is a leaf spring (12) made from an elastically resilient, metallic material.

7. Pivotable binding system as claimed in claim 1, wherein the binding element (11) is a strip which is resistant to expansion and substantially to shrinkage but which is resiliently deformable and flexible in a direction perpendicular to the two broad sides (13, 14) thereof.

8. Pivotable binding system as claimed in claim 1, wherein the rolling body (22) has at least three rolling surfaces (25, 26, 27) spaced at a distance from one another, the top rolling surface (27) in the height direction forming a predefined rolling path for the binding element (11) when the tread surface (5) is pivoted upwards relative to the sports device (2) and the rolling surfaces (25, 26) lying lower than the top rolling surface (27) and disposed on either side of the top rolling surface (27) are designed to roll the toe region of the shoe sole (6) in a direction towards the sports device (2) when the shoe sole (6) is pivoted upwards relative to the sports device (2).

9. Pivotable binding system as claimed in claim 8, wherein the centre rolling surface (27) on the rolling body (22) forms a slide track for the leaf-spring binding element (11) and side faces (31, 32) of the projection (28) on the rolling body (22) are designed to abut largely without any clearance with side walls (33, 34) of the groove-shape recess (29) in the shoe sole (6) to form the lateral guide device (30).

10. Pivotable binding system as claimed in claim 8, wherein the rolling surfaces (25, 26) on either side of the centre rolling surface (27) form a slide track for the rolling movement of the shoe sole (6).

11. Pivotable binding system as claimed in claim 1, wherein a deformation resistance perpendicular to the broad sides (13, 14) of the binding element (11) is dimensioned so as to be greater than a gravitational force acting on the binding element (11) through the sports device (2).

12. Pivotable binding system as claimed in claim 1, wherein the tread surface (5) or the shoe sole (6) cooperates with an elastically resilient spring means (39, 41) which forces the tread surface (5) into a position extending almost parallel with the sports device (2).

13. Pivotable binding system as claimed in claim 12, wherein the spring means (39) is a damping body (40) which is elastically flexible and resilient when pressure is applied, in particular made from an elastomeric synthetic material, in the toe region of the tread surface (5) between it and the sports device (2).

14. Pivotable binding system as claimed in claim 12, wherein the spring means (41) is a tension band (42) which is elastically flexible and resilient when subjected to tensile stress, in particular made from an elastomer synthetic material, and is arranged before the joining point, relative to the longitudinal direction (9) of the tread surface (5), between the binding element (11) and the shoe sole (6), being joined to the shoe sole (6) on one end and to the sports device (2) on the other.

15. Pivotable binding system as claimed in claim 1, wherein the return movement of the binding element (11) in a vertical direction starting from the sports device (2) is restricted by an anti-liftoff mechanism (52) comprising a tension-resistant securing element (53) joined to the sports device (2) and the shoe sole (6).

16. Pivotable binding system as claimed in claim 1, wherein the deformability of the binding element (11) in the vertical plane (8) is restricted and may not be deformed in a vertical direction, starting from the sports device (2), beyond an initial shape or a shape in its rest state or beyond a substantially longitudinally extended configuration.

* * * * *